US009418590B2

(12) United States Patent
Park et al.

(10) Patent No.: US 9,418,590 B2
(45) Date of Patent: Aug. 16, 2016

(54) ORGANIC LIGHT EMITTING DISPLAY DEVICE AND METHOD OF ADJUSTING LUMINANCE OF THE SAME

(71) Applicant: Samsung Display Co., Ltd., Yongin, Gyeonggi-do (KR)

(72) Inventors: Jin-Woo Park, Seoul (KR); Sang-Jin Pak, Yongin-si (KR)

(73) Assignee: Samsung Display Co., Ltd., Samsung-ro, Giheung-Gu, Yongin-si, Gyeonggi-do (KR)

( * ) Notice: Subject to any disclaimer, the term of this patent is extended or adjusted under 35 U.S.C. 154(b) by 40 days.

(21) Appl. No.: 14/455,015

(22) Filed: Aug. 8, 2014

(65) Prior Publication Data

US 2015/0042697 A1 Feb. 12, 2015

(30) Foreign Application Priority Data

Aug. 12, 2013 (KR) ..... 10-2013-0095205

(51) Int. Cl.
*G09G 3/32* (2016.01)
*G09G 3/20* (2006.01)

(52) U.S. Cl.
CPC ..... *G09G 3/3208* (2013.01); *G09G 3/2092* (2013.01); *G09G 2320/0233* (2013.01); *G09G 2320/0271* (2013.01); *G09G 2320/0285* (2013.01); *G09G 2320/043* (2013.01); *G09G 2320/045* (2013.01); *G09G 2360/141* (2013.01); *G09G 2360/145* (2013.01)

(58) Field of Classification Search
CPC ..... G09G 3/3406; G09G 3/3208; G09G 2320/045; G09G 2320/0271; G09G 2320/0285; G09G 3/2092; G09G 2320/04–2320/048
USPC ..... 345/690
See application file for complete search history.

(56) References Cited

U.S. PATENT DOCUMENTS

| | | | | |
|---|---|---|---|---|
| 8,736,638 | B2 * | 5/2014 | Shirouzu | G09G 3/2092 345/204 |
| 2011/0279488 | A1 * | 11/2011 | Nathan | G09G 3/3233 345/690 |
| 2012/0056916 | A1 | 3/2012 | Ryu et al. | |
| 2012/0212516 | A1 | 8/2012 | Ahn et al. | |
| 2012/0218314 | A1 * | 8/2012 | Purdy | G09G 3/3208 345/690 |
| 2013/0057595 | A1 | 3/2013 | Nathan et al. | |

FOREIGN PATENT DOCUMENTS

| | | | |
|---|---|---|---|
| KR | 1020110071983 | A | 6/2011 |
| KR | 1020120022411 | A | 3/2012 |
| KR | 1020120063049 | A | 6/2012 |

* cited by examiner

*Primary Examiner* — Larry Sternbane
(74) *Attorney, Agent, or Firm* — Robert E. Bushnell, Esq.

(57) ABSTRACT

A method of adjusting luminance of an organic light emitting display device is provided. By the method, initial compensation data are derived from optical images of a plurality of pixels, a look-up table (LUT) is generated using the initial compensation data, compensation data are derived by measuring deterioration degrees of the pixels, the LUT is updated by applying a filter for redistributing the compensation data among the pixels, an operation for adjusting the luminance are performed with image data of the pixels and the compensation data stored in the LUT, and driving data that are calculated by the operation for adjusting the luminance are outputted.

20 Claims, 7 Drawing Sheets

COMPENSATION DATA STORED IN LUT

| | | |
|---|---|---|
| 200 | 100 | 220 |
| 140 | 255 | 210 |
| 230 | 190 | 200 |

DETERIORATION DEGREE

| | | |
|---|---|---|
| x1.0 | x1.0 | x1.0 |
| x1.0 | x1.1 | x1.0 |
| x1.0 | x1.0 | x1.0 |

APPLYING FILTER

| | | |
|---|---|---|
| x1.0 | x1.025 | x1.0 |
| x1.025 | x1.0 | x1.025 |
| x1.0 | x1.025 | x1.0 |

| COMPENSATION DATA STORED IN LUT | | |
|---|---|---|
| 200 | 100 | 220 |
| 140 | 255 | 210 |
| 230 | 190 | 200 |

| DETERIORATION DEGREE | | |
|---|---|---|
| x1.0 | x1.0 | x1.0 |
| x1.0 | x1.1 | x1.0 |
| x1.0 | x1.0 | x1.0 |

| APPLYING FILTER | | |
|---|---|---|
| x1.0 | x1.025 | x1.0 |
| x1.025 | x1.0 | x1.025 |
| x1.0 | x1.025 | x1.0 |

DERIVE INITIAL COMPENSATION DATA

| | | |
|---|---|---|
| 200 | 100 | 235 |
| 140 | 240 | 210 |
| 230 | 190 | 200 |

ADJUST INITIAL COMPENSATION DATA

| | | |
|---|---|---|
| x1.0 | x1.025 | x1.0 |
| x1.025 | x0.9 | x1.025 |
| x1.0 | x1.025 | x1.0 |

DERIVE INITIAL COMPENSATION DATA

| | | |
|---|---|---|
| 200 | 100 | 235 |
| 140 | 80 | 210 |
| 230 | 190 | 200 |

ADJUST INITIAL COMPENSATION DATA

| | | |
|---|---|---|
| x1.0 | x0.975 | x1.0 |
| x0.975 | x1.1 | x0.975 |
| x1.0 | x0.975 | x1.0 |

ORGANIC LIGHT EMITTING DISPLAY DEVICE AND METHOD OF ADJUSTING LUMINANCE OF THE SAME

CLAIM OR PRIORITY

This application claims priority under 35 USC §119 to Korean Patent Applications No. 10-2013-0095205, filed on Aug. 12, 2013 in the Korean Intellectual Property Office (KIPO), the contents of which are incorporated herein in its entirety by reference.

BACKGROUND OF THE INVENTION

1. Technical Field

Embodiments of the present invention relate generally to a display device, and more particularly, to an organic light emitting display device and a method of adjusting luminance of the organic light emitting display device.

2. Description of the Related Art

An organic light emitting display device is generally driven by an analog driving method or a digital driving method. Specifically, the analog driving method implements a gray scale based on a variable voltage level of data, and the digital driving method implements a gray scale based on a variable time duration for which an organic light emitting diode emits light. While the analog driving method has difficulties in increasing size and/or resolution of a display panel included in the organic light emitting display device, the digital driving method may readily increase the size and/or resolution of the display panel because the digital driving method requires an integrated circuit (IC) having a simpler structure compared to the analog driving method. In addition, since the digital driving method uses just two states (i.e., an on state and an off state) of a driving thin film transistor (TFT), the digital driving method seldom results in an image-quality degradation due to deteriorations and/or characteristic deviations of the driving TFT. Therefore, the digital driving method has many advantages for a big-size display panel. Recently, a hybrid driving method that combines characteristics of the analog driving method with characteristics of the digital driving method has been developed. Like the digital driving method, however, the hybrid driving method also drives an organic light emitting diode based on a constant voltage. As a result, the digital driving method and the hybrid driving method have some problems such as a rapid deterioration of the organic light emitting diode, non-uniform luminance, etc.

SUMMARY OF THE INVENTION

Some embodiments of the present invention provide an organic light emitting display device capable of compensating luminance degradation caused by a deterioration of an organic light emitting diode.

Some embodiments of the present invention provide a method of adjusting luminance of an organic light emitting display device capable of maintaining an average luminance and improving an ability to express a low gray scale.

According to some embodiments, a method of adjusting luminance of an organic light emitting display device may include a step of deriving initial compensation data from optical images of a plurality of pixels, a step of generating a look-up table (LUT) using the initial compensation data, a step of deriving compensation data by measuring deterioration degrees of the pixels, a step of updating the LUT by applying a filter to the compensation data, a step of performing an operation for adjusting the luminance with image data of the pixels and the compensation data stored in the LUT, and a step of outputting driving data that are calculated by the operation for adjusting the luminance. The compensation data are redistributed among the pixels by the filter.

In some embodiments, a first compensation data corresponding to a first pixel may be distributed to compensation data of adjacent pixels that are adjacent to the first pixel and the LUT may be updated by the filter when the first compensation data is larger than a first threshold value.

In some embodiments, the first threshold value may correspond to an upper value of the LUT.

In some embodiments, the adjacent pixels may be four pixels that are adjacent to the first pixel in up, down, left, and right directions.

In some embodiments, the adjacent pixels may be eight pixels that enclose the first pixel.

In some embodiments, the first compensation data may be equally distributed to the compensation data of the adjacent pixels by the filter.

In some embodiments, the first compensation data may be unequally distributed to the compensation data of the adjacent pixels by the filter.

In some embodiments, the step of generating the LUT may include a step of comparing a first initial compensation data corresponding to a second pixel with a second threshold value and a step of distributing the first initial compensation data to initial compensation data of pixels that are adjacent to the second pixel when the first initial compensation data is larger than the second threshold value.

In some embodiments, the step of generating the LUT may include a step of comparing a second initial compensation data corresponding to a third pixel with a third threshold value and a step of distributing compensation data of pixels that are adjacent to the third pixel to the second initial compensation data when the second initial compensation data is smaller than the third threshold value.

According to some embodiments, an organic light emitting display device may include a display panel having a plurality of pixel circuits, a scan driving unit configured to provide a scan signal to the pixel circuits, a data driving unit configured to provide a data signal to the pixel circuits, a compensation unit configured to measure deterioration degrees of the pixel circuits, and to compensate luminance of the pixel circuits, and a timing control unit configured to control the scan driving unit and the data driving unit. The compensation unit may redistribute compensation data among the pixel circuits.

In some embodiments, the compensation unit may include a deterioration sensing unit configured to derive the compensation data by measuring the deterioration degrees of the pixel circuits, a look-up table (LUT) updating unit configured to update a LUT by applying a filter to the compensation data, and a luminance adjusting unit configured to perform an operation for adjusting the luminance with an image data of the pixel circuits and the compensation data stored in the LUT, and to output driving data that are calculated by the operation for adjusting the luminance.

In some embodiments, the filter may distribute a first compensation data corresponding to a first pixel circuit to compensation data of adjacent pixel circuits that are adjacent to the first pixel circuit and may update the LUT when the first compensation data is larger than a first threshold value.

In some embodiments, the first threshold value may correspond to an upper value of the LUT.

In some embodiments, the adjacent pixel circuits may be four pixel circuits that are adjacent to the first pixel circuit in up, down, left, and right directions.

In some embodiments, the adjacent pixel circuits may be eight pixel circuits that enclose the first pixel circuit.

In some embodiments, the filter may distribute the first compensation data equally to the compensation data of the adjacent pixel circuits.

In some embodiments, the filter may distribute the first compensation data unequally to the compensation data of the adjacent pixel circuits.

In some embodiments, the compensation unit may further include a LUT generating unit configured to derive initial compensation data from optical images of the pixel circuits, and to generate the LUT using the initial compensation data.

In some embodiments, the LUT generating unit may distribute a first initial compensation data corresponding to a second pixel circuit to initial compensation data of pixel circuits that are adjacent to the second pixel circuit when the first initial compensation data is larger than a second threshold value.

In some embodiments, the LUT generating unit may distribute initial compensation data of pixel circuits that are adjacent to a third pixel circuit to a second initial compensation data corresponding to the third pixel circuit when the second initial compensation data is smaller than a third threshold value.

Therefore, an organic light emitting display device and a method of adjusting luminance of an organic light emitting display device according to embodiments of the present invention may improve an ability to express a low gray scale, and may secure a margin for deterioration compensation by redistributing initial compensation data among the pixels when a LUT is generated. In addition, the organic light emitting display device and the method of adjusting luminance of the organic light emitting display device may maintain an average luminance by redistributing compensation data among the pixels when the LUT is updated.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings, in which like reference symbols indicate the same or similar components, wherein.

DETAILED DESCRIPTION OF THE INVENTION

Figure 1:
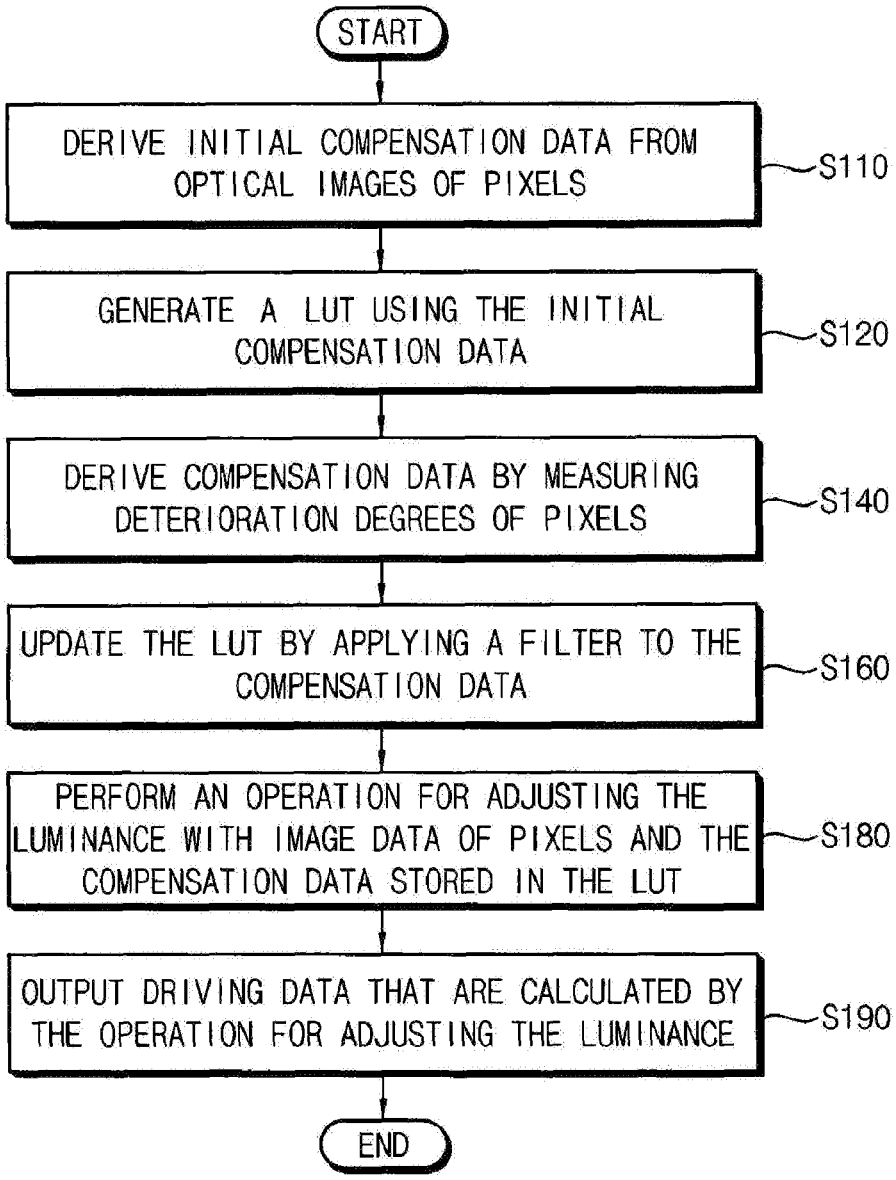
FIG. 1 is a flow chart illustrating a method of adjusting luminance of an organic light emitting display device according to an embodiment of the present invention.

Various embodiments will be described more fully hereinafter with reference to the accompanying drawings, in which some embodiments are shown. The present inventive concept may, however, be embodied in many different forms and should not be construed as limited to the embodiments set forth herein. Rather, these embodiments are provided so that this disclosure will be thorough and complete, and will fully convey the scope of the present inventive concept to those skilled in the art. In the drawings, the sizes and relative sizes of layers and regions may be exaggerated for clarity. Like numerals refer to like elements throughout.

It will be understood that, although the terms first, second, third etc. may be used herein to describe various elements, these elements should not be limited by these terms. These terms are used to distinguish one element from another. Thus, a first element discussed below could be termed a second element without departing from the teachings of the present inventive concept. As used herein, the term "and/or" includes any and all combinations of one or more of the associated listed items.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of the present inventive concept. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

FIG. 1 is a flow chart illustrating a method of adjusting luminance of an organic light emitting display device according to an embodiment of the present invention.

Referring to FIG. 1, the method of FIG. 1 may derive initial compensation data from optical images of a plurality of pixels of the organic light emitting display device (S110), may generate a look-up table (LUT) using the derived initial compensation data (S120), may derive compensation data by measuring deterioration degrees of the pixels (S140), may update the LUT by applying a filter to the compensation data (S160), may perform an operation for adjusting the luminance with image data of the pixels and the compensation data stored in the LUT (S180), and may output driving data that are calculated by the operation for adjusting the luminance (S190).

Specifically, the initial compensation data may be derived from optical images of the pixels (S110), and the LUT may be generated using the initial compensation data (S120). The LUT may store compensation data for compensating luminance of the pixels. The compensation data stored in the LUT may be matched to the pixels by a ratio of 1:1 or 1:N. Initially, the LUT may be generated using the initial compensation data only once. A deviation of transistors of the pixels may be reduced using the initial compensation data. Thus, the pixels may have equal luminance. In one embodiment, the initial compensation data may be redistributed among the pixels. The initial compensation data may be redistributed among the pixels for improving an ability to express a low gray scale and securing a margin for deterioration compensation. The compensation data may be derived by measuring deterioration degrees of the pixels (S140), and the LUT may be updated by applying a filter to the compensation data (S160). The organic light emitting display device may maintain an average luminance by redistributing the compensation data among the pixels by the filter. In one embodiment, the LUT may be updated at a predetermined time. In another embodiment, the LUT may be updated periodically. An operation for adjusting the luminance may be performed with image data of the pixels and the compensation data stored in the LUT (S180). Then, driving data that are calculated by the operation for adjusting the luminance may be outputted (S190). The driving data may be calculated by the operation for adjusting the luminance while the organic light emitting display device is driven.

Figure 2:
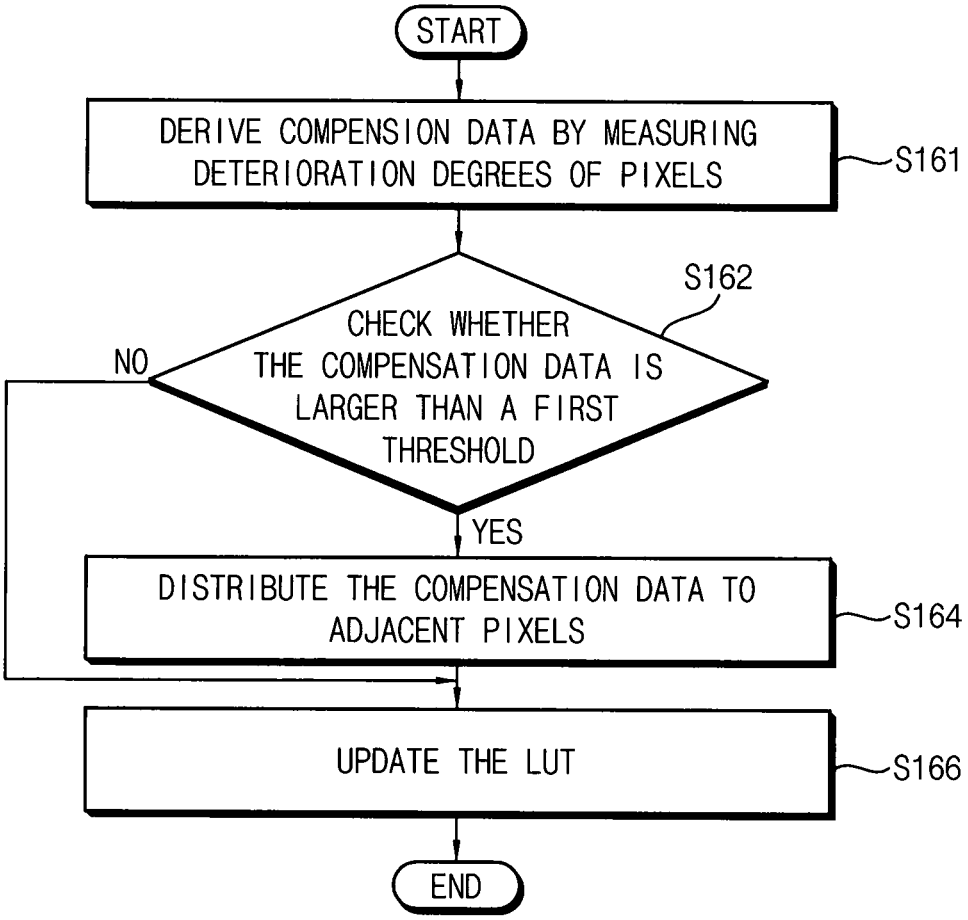
FIG. 2 is a flow chart illustrating an example in which a LUT is updated by applying a filter to compensation data in a method of FIG. 1.

FIG. 2 is a flow chart illustrating an example in which a LUT is updated by applying a filter to compensation data in a method of FIG. 1.

Referring to FIG. 2, the compensation data may be derived by measuring deterioration degrees of pixels (S161). The compensation data may be compared with a first threshold value (S162). The compensation data may be distributed to adjacent pixels by the filter when the compensation data is larger than the first threshold value (S164). The LUT may be updated using the compensation data that are redistributed by the filter (S166).

Specifically, deterioration degrees of pixels may be measured by deterioration sensors, and the compensation data may be derived from the deterioration degrees of pixels (S161). A first compensation data corresponding to a first pixel may be compared with the first threshold value (S162). The first compensation data may be distributed to compensation data of adjacent pixels that are adjacent to the first pixel by the filter when the first compensation data is larger than the first threshold value (S164). An organic light emitting display device may maintain an average luminance by distributing the first compensation data to compensation data of the adjacent pixels that are adjacent to the first pixel when the first pixel does not have an enough margin for deterioration compensation. In one embodiment, the first threshold value may correspond to an upper value of the LUT. In one embodiment, the adjacent pixels may be four pixels that are adjacent to the first pixel in up, down, left, and right directions. In another embodiment, the adjacent pixels may be eight pixels that enclose the first pixel. In one embodiment, the first compensation data may be equally distributed to the compensation data of the adjacent pixels by the filter. In another embodiment, the first compensation data may be unequally distributed to the compensation data of the adjacent pixels by the filter. In this case, one of the adjacent pixels of the first pixel, which has a relatively smaller compensation data comparing to the compensation data of other adjacent pixels of the first pixel, may receive a relatively larger portion of the distribution from the first pixel. The LUT may be updated using the compensation data that are redistributed by the filter (S166).

Figures 3, 4:
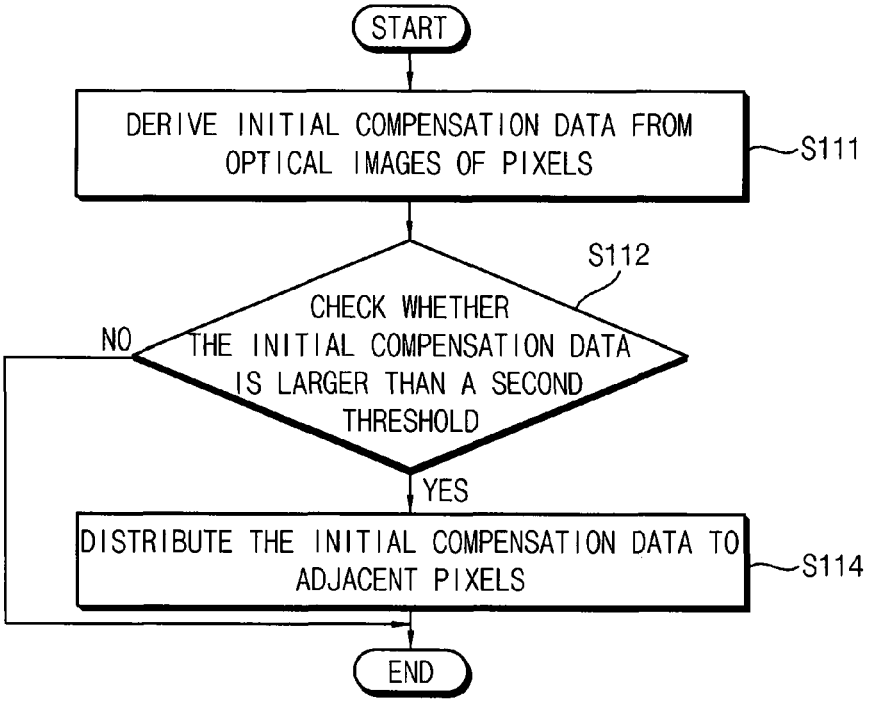
FIG. 3 is a diagram illustrating an example in which compensation data are redistributed among pixels by a filter in a method of FIG. 1.
FIG. 4 is a flow chart illustrating an example in which a LUT is generated in a method of FIG. 1.

FIG. 3 is a diagram illustrating an example in which compensation data are redistributed among pixels by a filter in a method of FIG. 1.

Referring to FIG. 3, deterioration degrees of pixels may be measured by deterioration sensors, and a rate of compensation may be determined by deterioration degrees of pixels. When a first compensation data corresponding to a first pixel is larger than a first threshold value, the first compensation data corresponding to the first pixel may be distributed to compensation data of adjacent pixels that are adjacent to the first pixel by the filter. For example, in a LUT that can store 8-bits data, if the first compensation data corresponding to the first pixel already has an upper value (e.g., indicated as 255) of the LUT, and the first pixel is deteriorated at 10%, excessive compensation data (e.g., 10%) may be distributed to compensation data of four pixels that are adjacent to the first pixel in up, down, left, and right directions at an equal rate (e.g., 2.5%), and the LUT may be updated by the filter.

FIG. 4 is a flow chart illustrating an example in which a LUT is generated in a method of FIG. 1.

Referring to FIG. 4, initial compensation data may be derived from optical images of a plurality of pixels (S111). The initial compensation data may be compared with a second threshold value (S112). If the initial compensation data is larger than the second threshold value, the initial compensation data may be distributed to adjacent pixels (S114).

Specifically, the initial compensation data may be derived from optical images of the pixels (S111). A deviation of transistors of the pixels may be reduced using the initial compensation data. Thus, the pixels may have equal luminance. A first initial compensation data corresponding to a second pixel may be compared with the second threshold value (S112). If the first initial compensation data corresponding to the second pixel is larger than the second threshold value, the first initial compensation data corresponding to the second pixel may be distributed to initial compensation data of pixels that are adjacent to the second pixel (S114).

Figures 5, 6:
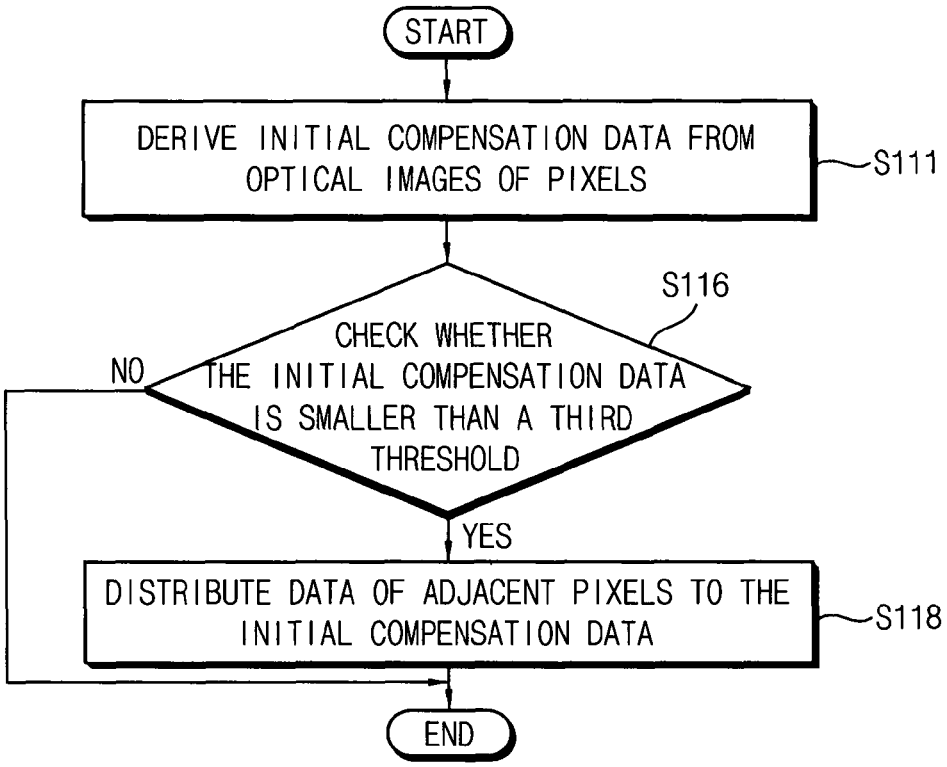
FIG. 5 is a diagram illustrating an example in which a LUT is generated by redistributing initial compensation data among pixels in a method of FIG. 4.
FIG. 6 is a flow chart illustrating another example in which a LUT is generated in a method of FIG. 1.

FIG. 5 is a diagram illustrating an example in which a LUT is generated by redistributing initial compensation data among pixels in a method of FIG. 4.

Referring to FIG. 5, the initial compensation data may be derived from optical images of the pixels. If a first initial compensation data corresponding to a second pixel is larger than a second threshold value, the first initial compensation data corresponding to the second pixel may be distributed to initial compensation data of pixels that are adjacent to the second pixel for securing a margin for deterioration compensation. For example, in a LUT that can store 8-bits data, if the first initial compensation data (e.g., indicated as 240) corresponding to the second pixel is larger than the second threshold value, the first initial compensation data corresponding to the second pixel may be distributed to initial compensation data of four pixels that are adjacent to the second pixel in up, down, left, and right directions at an equal rate (e.g., 2.5%).

FIG. 6 is a flow chart illustrating another example in which a LUT is generated in a method of FIG. 1.

Referring to FIG. 6, initial compensation data may be derived from optical images of a plurality of pixels (S111). The initial compensation data may be compared with a third threshold value (S116). If the initial compensation data is smaller than the third threshold value, data of adjacent pixels may be distributed to the initial compensation data (S118).

Specifically, the initial compensation data may be derived from optical images of the pixels (S111). A deviation of transistors of the pixels may be reduced using the initial compensation data. Thus, the pixels may have equal luminance. A second initial compensation data corresponding to a third pixel may be compared with the third threshold value (S116). If the second initial compensation data corresponding to the third pixel is smaller than the third threshold value, initial compensation data of pixels that are adjacent to the third pixel may be distributed to the second initial compensation data corresponding to the third pixel (S118).

Figures 7, 8:
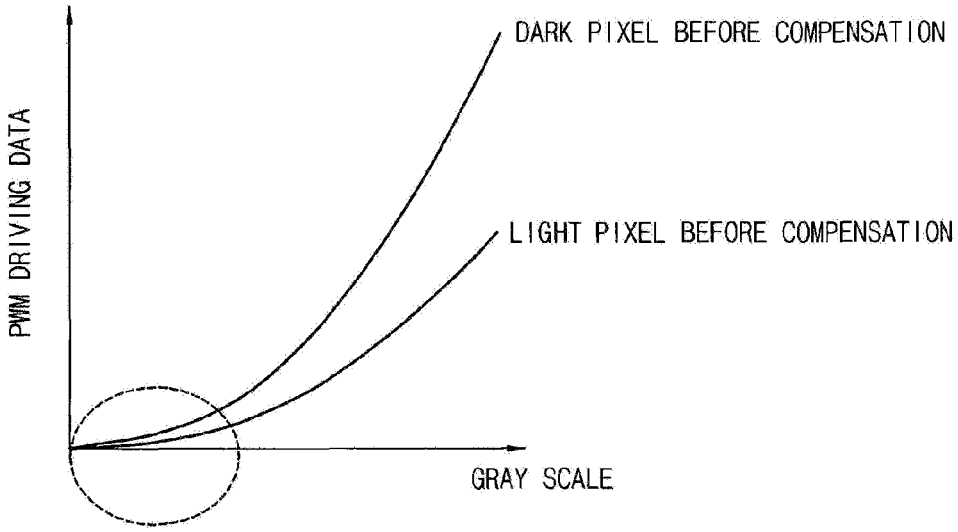
FIG. 7 is a diagram illustrating an ability to express a low gray scale of a pixel.
FIG. 8 is a diagram illustrating an example in which a LUT is generated by redistributing initial compensation data among pixels in a method of FIG. 6.

FIG. 7 is a diagram illustrating an ability to express a low gray scale of a pixel.

Referring to FIG. 7, luminance of a pixel may be determined by pulse-width-modulation (PWM) driving data in the digital driving method or the hybrid driving method. Therefore, the ability to express the low gray scale of the pixel may be determined by bit depth of the PWM driving data. In a pixel driven by a PWM driving data having small depth (i.e., a light pixel before compensation), the ability to express the low gray scale may be bad because the bit depth is not sufficient. Therefore, if a second initial compensation data corresponding to a third pixel is smaller than a third threshold value, initial compensation data of pixels that are adjacent to the third pixel may be distributed to the second initial compensation data corresponding to the third pixel. The ability to express the low gray scale of the pixel can be improved.

FIG. 8 is a diagram illustrating an example in which a LUT is generated by redistributing initial compensation data among pixels in a method of FIG. 6.

Referring to FIG. 8, the initial compensation data may be derived from optical images of the pixels. If a second initial compensation data corresponding to a third pixel is smaller than a third threshold value, initial compensation data of pixels that are adjacent to the third pixel may be distributed to the second initial compensation data corresponding to the third pixel for improving an ability to express the low gray scale of the third pixel. For example, in a LUT that can store 8-bits data, if the third initial compensation data (e.g., indicated as 80) of the third pixel is smaller than the third threshold value, initial compensation data of four pixels that are adjacent to the third pixel in up, down, left, and right directions may be distributed to the second initial compensation data at an equal rate (e.g., 2.5%).

Figure 9:
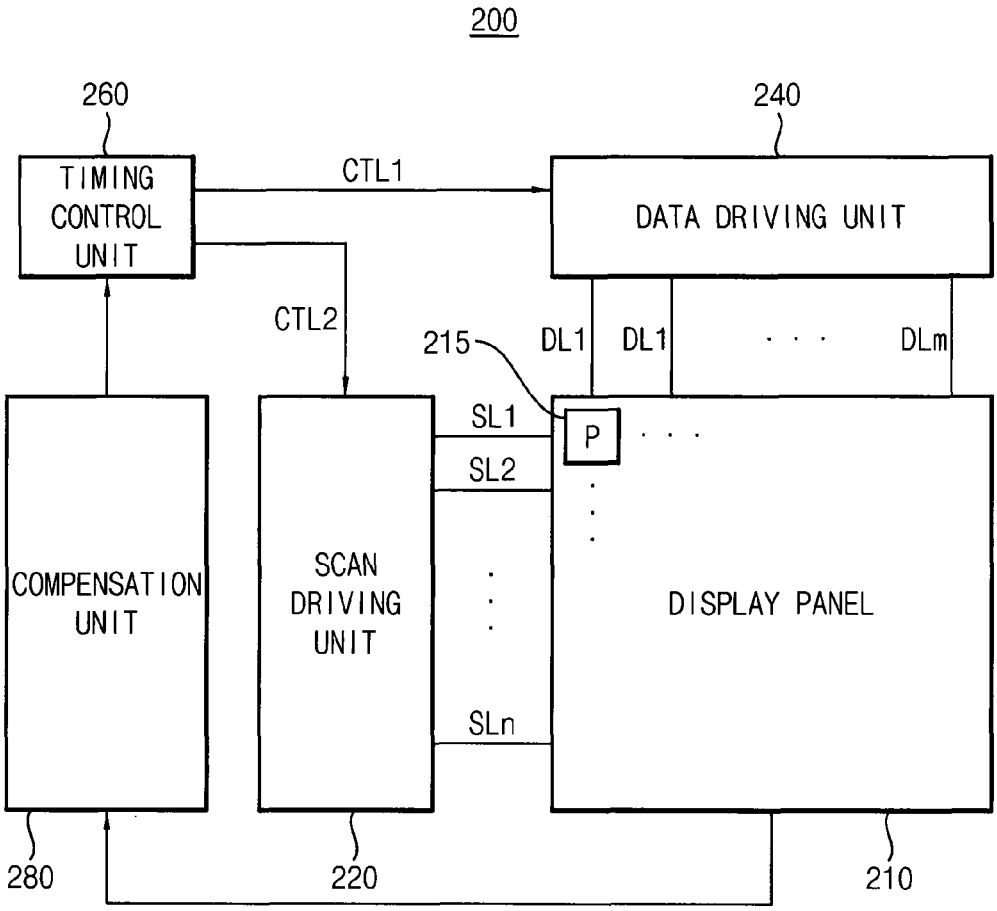
FIG. 9 is a block diagram illustrating an organic light emitting display device according to some embodiments.

FIG. 9 is a block diagram illustrating an organic light emitting display device according to embodiments of the present invention.

Referring to FIG. 9, the organic light emitting display device 200 may include a display panel 210, a scan driving unit 220, a data driving unit 240, a timing control unit 260, and a compensation unit 280.

The display panel 210 may include a plurality of pixel circuits 215. The display panel 210 may be coupled to the scan driving unit 220 via a plurality of scan-lines SL1 through SLn, and may be coupled to the data driving unit 240 via a plurality of data-lines DL1 through DLm. Here, the display panel 210 may include n*m pixel circuits 215 because the pixel circuits 215 are arranged at locations corresponding to crossing points of the scan-lines SL1 through SLn and the data-lines DL1 through DLm.

The scan driving unit 220 may provide a scan signal to the pixel circuits 215 via the scan-lines SL1 through SLn. The scan driving unit 220 may include at least one scan driver IC. The scan driving unit 220 may be located at one or more sides of the display panel 210. The scan driving unit 220 may be coupled to the display panel 210 using a chip-on flexible printed circuit (COF), a chip-on glass (COG), a flexible printed circuit (FPC), etc.

The data driving unit 240 may provide a data signal to the pixel circuits 215 via the data-lines DL1 through DLm. The data driving unit 240 may include at least one data driver IC. The data driving unit 240 may be located at one or more sides of the display panel 210. The data driving unit 240 may be coupled to the display panel 210 using the COF, the COG, the FPC, etc.

The timing control unit 260 may control at least one of the scan driving unit 220, the data driving unit 240, and the compensation unit 280. For convenience of description, it is illustrated in FIG. 9 that the timing control unit 260 controls the scan driving unit 220 and the data driving unit 240 based on control signals (CTL1, CTL2). The timing control unit 260 may be coupled to the display panel 210 using the COF, the COG, the FPC, etc.

The compensation unit 280 may update a LUT periodically by measuring deterioration degrees, may perform an operation for adjusting the luminance, and may output driving data that are calculated by the operation for adjusting the luminance. The compensation unit 280 may be implemented in various forms. For example, the compensation unit 280 may provide driving data to the timing control unit 260. Alternatively, the compensation unit 280 may be located within in the data driving unit 240. In this case, the compensation unit 280 may provide the data signal to the pixel circuits 215. For convenience of description, it is illustrated in FIG. 9 that the compensation unit 280 provides the driving data that is applied to luminance compensation of the pixel circuits to the timing control unit 260.

Figure 10:
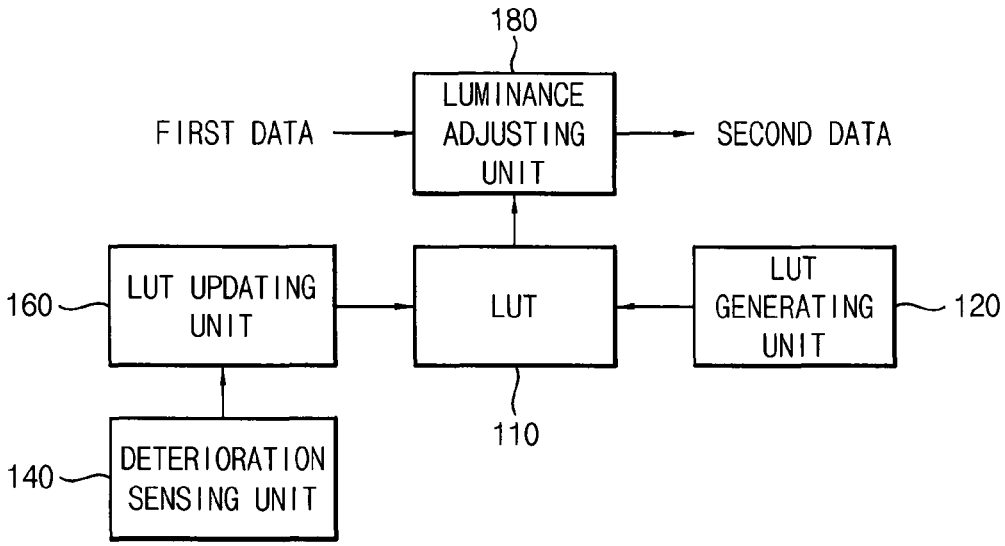
FIG. 10 is a block diagram illustrating a compensation unit of an organic light emitting display device of FIG. 9.

FIG. 10 is a block diagram illustrating a compensation unit of an organic light emitting display device of FIG. 9.

Referring to FIG. 10, the compensation unit of the organic light emitting display device may include a LUT 110, a LUT generating unit 120, a deterioration sensing unit 140, a LUT updating unit 160, and a luminance adjusting unit 180.

The LUT 110 may store compensation data for compensating luminance of the pixel circuits. The compensation data stored in the LUT 110 may be matched to the pixel circuits by a ratio of 1:1 or 1:N. The LUT 110 may be implemented by a programmable-read-only-memory (PROM), an erasable PROM (EPROM), electrically erasable PROM (EEPROM), a flash memory, etc.

The LUT generating unit 120 may derive initial compensation data from optical images of the pixel circuits, and may generate the LUT 110 using the initial compensation data. Initially, the LUT generating unit 120 may generate the LUT 110 only once. Luminance of the pixel circuits may be measured using an optical images device. The LUT generating unit 120 may derive initial compensation data. A deviation of transistors of the pixel circuits may be reduced using the initial compensation data. Thus, the pixel circuits may have equal luminance. In one embodiment, the LUT generating unit 120 may distribute a first initial compensation data corresponding to a second pixel circuit to initial compensation data of pixel circuits that are adjacent to the second pixel circuit when the first initial compensation data corresponding to the second pixel circuit is larger than a second threshold value. A margin for deterioration compensation may be secured by distributing the first initial compensation data corresponding to the second pixel circuit to initial compensation data of pixel circuits that are adjacent to the second pixel circuit when the LUT is generated. Therefore, if the pixel circuits are deteriorated later, the pixel circuits may maintain the luminance by adjusting the compensation data stored in the LUT. The second threshold value may be smaller than an upper value of the LUT for securing a margin for deterioration compensation. In one embodiment, the LUT generating unit 120 may distribute initial compensation data of pixel circuits that are adjacent to a third pixel circuit to a second initial compensation data corresponding to the third pixel circuit when the second initial compensation data corresponding to the third pixel circuit is smaller than a third threshold value. An ability to express a low gray scale of the third pixel may be improved by distributing initial compensation data of pixel circuits that are adjacent to the third pixel circuit to the second initial compensation data corresponding to the third pixel circuit when the LUT is generated.

The deterioration sensing unit 140 may measure the deterioration degrees of the pixel circuits by deterioration sensors and may derive the compensation data.

The LUT updating unit 160 may update the LUT 110 by applying a filter to the compensation data. In one embodiment, the LUT 110 may be updated at a predetermined time. In another embodiment, the LUT 110 may be updated periodically. In one embodiment, the filter distributes a first compensation data corresponding to a first pixel circuit to compensation data of adjacent pixel circuits that are adjacent to the first pixel circuit and updates the LUT when the first compensation data is larger than a first threshold value. The organic light emitting display device may maintain an average luminance by redistributing compensation data among the pixel circuits when luminance of the pixel circuits cannot be compensated because a margin for deterioration compensation is not sufficient. In one embodiment, the first threshold value corresponds to an upper value of the LUT. In one embodiment, the adjacent pixel circuits are four pixel circuits that are adjacent to the first pixel circuit in up, down, left, and right directions. In another embodiment, the adjacent pixel circuits are eight pixel circuits that enclose the first pixel circuit. In one embodiment, the filter distributes the first compensation data equally to the compensation data of the adjacent pixel circuits. In another embodiment, the filter distributes the first compensation data unequally to the compensation data of the adjacent pixel circuits. Since theses are described above, duplicated description will not be repeated.

The luminance adjusting unit 180 may perform an operation for adjusting the luminance with first data having image data of the pixel circuits and the compensation data stored in the LUT. The luminance adjusting unit 180 may output second data having driving data that are calculated by the operation for adjusting the luminance while the organic light emitting display device is driven. The organic light emitting display device may maintain an average luminance by the operation for adjusting the luminance.

Figure 11:
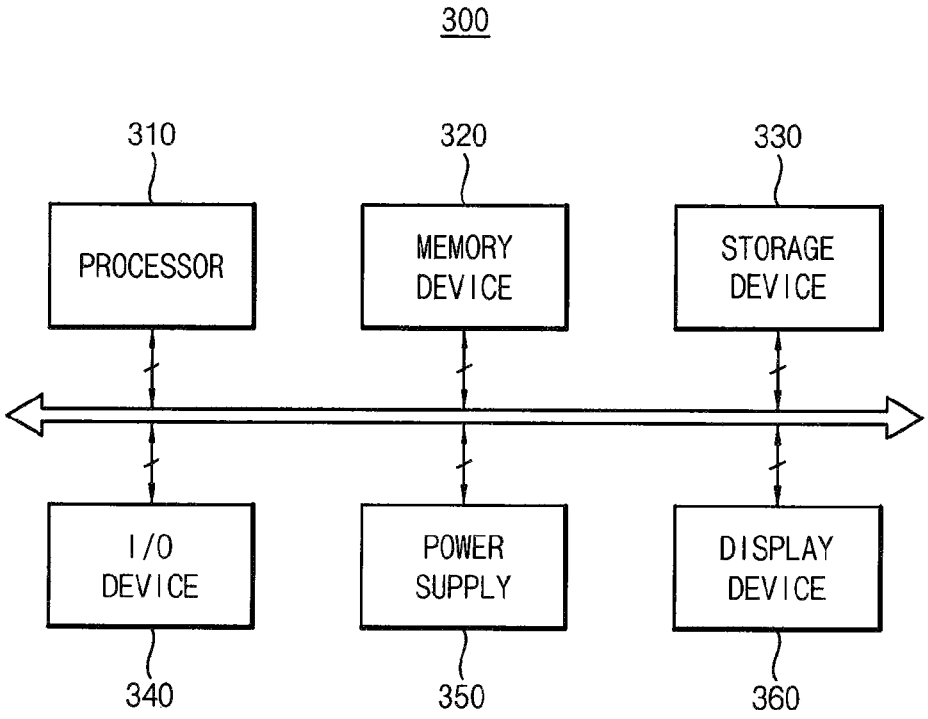
FIG. 11 is an electronic device having an organic light emitting display device according to some embodiments.

FIG. 11 is an electronic device having an organic light emitting display device according to embodiments of the present invention.

Referring to FIG. 11, an electronic device 300 may include a processor 310, a memory device 320, a storage device 330, an input/output (I/O) device 340, a power supply 350, and a display device 360. Here, the electronic device 300 may further include a plurality of ports for communicating a video card, a sound card, a memory card, a universal serial bus (USB) device, other electronic devices, etc.

The processor 310 may perform various computing functions. The processor 310 may be a micro processor, a central processing unit (CPU), etc. The processor 310 may be coupled to other components via an address bus, a control bus, a data bus, etc. Further, the processor 310 may be coupled to an extended bus such as a peripheral component interconnection (PCI) bus.

The memory device 320 may store data for operations of the electronic device 300. For example, the memory device 320 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc, and/or at least one volatile memory device such as a dynamic random access memory (DRAM) device, a static random access memory (SRAM) device, a mobile DRAM device, etc.

The storage device 330 may be a solid state drive (SSD) device, a hard disk drive (HDD) device, a CD-ROM device, etc. The I/O device 340 may be an input device such as a keyboard, a keypad, a touchpad, a touch-screen, a mouse, etc, and an output device such as a printer, a speaker, etc. The power supply 350 may provide a power for operations of the electronic device 300. The display device 360 may communicate with other components via the buses or other communication links. In one embodiment, the display device 360 may be driven with a digital driving method or a hybrid driving method. The display device 360 may correspond to the organic light emitting display device 200 of FIG. 9. The display device 360 may include a display panel, a scan driving unit, a data driving unit, a timing control unit, a compensation unit, etc.

Although it is described above that the present inventive concept is applied to the organic light emitting display device, the present inventive concept may also be applied to a liquid crystal display (LCD) device.

The present inventive concept may be applied to an electronic device having a display device. For example, the present inventive concept may be applied to a television, a computer monitor, a laptop, a digital camera, a cellular phone, a smart phone, a smart pad, a personal digital assistant (PDA), a portable multimedia player (PMP), a MP3 player, a navigation system, a game console, a video phone, etc.

The foregoing is illustrative of embodiments and is not to be construed as limiting thereof. Although a few embodiments have been described, those skilled in the art will readily appreciate that many modifications are possible in the embodiments without materially departing from the novel teachings and advantages of the present inventive concept. Accordingly, all such modifications are intended to be included within the scope of the present inventive concept as defined in the claims. Therefore, it is to be understood that the foregoing is illustrative of various embodiments and is not to be construed as limited to the specific embodiments disclosed, and that modifications to the disclosed embodiments, as well as other embodiments, are intended to be included within the scope of the appended claims.

What is claimed is:

1. A method of adjusting luminance of an organic light emitting display device, the method comprising:

deriving initial compensation data from optical images of a plurality of pixels of the organic light emitting display device;

generating a look-up table (LUT) using the initial compensation data;

deriving compensation data by measuring deterioration degrees of the pixels;

updating the LUT by applying a filter to the compensation data;

performing an operation for adjusting the luminance with image data of the pixels and the compensation data stored in the LUT; and outputting driving data that are calculated by the operation for adjusting the luminance, the compensation data being redistributed among the pixels by the filter.

2. The method of claim 1, wherein a first compensation data corresponding to a first pixel is distributed to compensation data of adjacent pixels that are adjacent to the first pixel and the LUT is updated by the filter when the first compensation data is larger than a first threshold value.

3. The method of claim 2, wherein the first threshold value corresponds to an upper value of the LUT.

4. The method of claim 2, wherein the adjacent pixels are four pixels that are adjacent to the first pixel in a row direction and a column direction crossing the row direction.

5. The method of claim 2, wherein the adjacent pixels are eight pixels that enclose the first pixel.

6. The method of claim 2, wherein the first compensation data is equally distributed to the compensation data of the adjacent pixels by the filter.

7. The method of claim 2, wherein the first compensation data is unequally distributed to the compensation data of the adjacent pixels by the filter.

8. The method of claim 1, wherein generating the LUT includes:

comparing a first initial compensation data corresponding to a second pixel with a second threshold value; and distributing the first initial compensation data to initial compensation data of pixels that are adjacent to the second pixel when the first initial compensation data is larger than the second threshold value.

9. The method of claim 1, wherein generating the LUT includes:

comparing a second initial compensation data corresponding to a third pixel with a third threshold value; and distributing compensation data of pixels that are adjacent to the third pixel to the second initial compensation data when the second initial compensation data is smaller than the third threshold value.

10. An organic light emitting display device comprising:

a display panel having a plurality of pixel circuits;

a scan driving unit providing a scan signal to the pixel circuits;

a data driving unit providing a data signal to the pixel circuits;

a compensation unit deriving compensation data based on deterioration degrees of the pixel circuits and redistributing the compensation data among adjacent ones of the pixel circuits to compensate luminance of the pixel circuits when the compensation data is larger than a threshold value; and a timing control unit controlling the scan driving unit and the data driving unit.

11. The device of claim 10, wherein the compensation unit includes:

a deterioration sensing unit deriving the compensation data by measuring the deterioration degrees of the pixel circuits;

a look-up table (LUT) updating unit updating a LUT by applying a filter to the compensation data; and a luminance adjusting unit performing an operation for adjusting the luminance with an image data of the pixel circuits and the compensation data stored in the LUT, and outputting driving data that are calculated by the operation for adjusting the luminance.

12. The device of claim 11, wherein the filter distributes a first compensation data corresponding to a first pixel circuit to compensation data of the adjacent ones of pixel circuits that are adjacent to the first pixel circuit and updates the LUT when the first compensation data is larger than a first threshold value.

13. The device of claim 12, wherein the first threshold value corresponds to an upper value of the LUT.

14. The device of claim 12, wherein the adjacent pixel circuits are four pixel circuits that are adjacent to the first pixel circuit in a row direction and a column direction crossing the row direction.

15. The device of claim 12, wherein the adjacent pixel circuits are eight pixel circuits that enclose the first pixel circuit.

16. The device of claim 12, wherein the filter distributes the first compensation data equally to the compensation data of the adjacent pixel circuits.

17. The device of claim 12, wherein the filter distributes the first compensation data unequally to the compensation data of the adjacent pixel circuits.

18. The device of claim 11, wherein the compensation unit further includes a LUT generating unit deriving initial compensation data from optical images of the pixel circuits, and generating the LUT using the initial compensation data.

19. The device of claim 18, wherein the LUT generating unit distributes a first initial compensation data corresponding to a second pixel circuit to initial compensation data of pixel circuits that are adjacent to the second pixel circuit when the first initial compensation data is larger than a second threshold value.

20. The device of claim 18, wherein the LUT generating unit distributes initial compensation data of pixel circuits that are adjacent to a third pixel circuit to a second initial compensation data corresponding to the third pixel circuit when the second initial compensation data is smaller than a third threshold value.

* * * * *